United States Patent [19]

MacDonnell

[11] 3,946,873

[45] Mar. 30, 1976

[54] AB-TYPE PISTON ASSEMBLY SHIPPING COVER

[75] Inventor: Robert W. MacDonnell, Crete, Ill.

[73] Assignee: Unity Railway Supply Co., Inc., Chicago, Ill.

[22] Filed: July 5, 1974

[21] Appl. No.: 485,970

Related U.S. Application Data

[63] Continuation of Ser. No. 273,219, July 19, 1972, abandoned.

[52] U.S. Cl. ..... 206/521

[51] Int. Cl.[2] ..... B65D 81/02

[58] Field of Search ..... 206/319, 318, 521; 92/169

[56] References Cited

UNITED STATES PATENTS

| | | | |
|---|---|---|---|
| 2,880,043 | 3/1959 | Landis | 92/169 X |
| 2,982,395 | 5/1961 | Rados | 206/319 |
| 3,055,495 | 9/1962 | Naimer | 206/521 |
| 3,136,413 | 6/1964 | Hall | 206/305 |
| 3,168,854 | 2/1965 | Neilson | 92/169 X |

*Primary Examiner*—Leonard Summer

*Attorney, Agent, or Firm*—Hume, Clement, Brinks, Willian, Olds & Cook, Ltd.

[57] ABSTRACT

A dual purpose shipping cover serving, in conjunction with locking means, as a cover for a conventional air brake cylinder containing an AB type railroad air brake piston assembly and serving in a matched pair, in conjunction with said locking means as a composite container for the AB piston. The cover has a stepped cylindrical contour to conform to both the piston end and the head end of the piston assembly.

3 Claims, 6 Drawing Figures

AB-TYPE PISTON ASSEMBLY SHIPPING COVER

This is a continuation of application Ser. No. 273,219, filed July 19, 1972, now abandoned.

BACKGROUND OF THE INVENTION

This invention relates to a shipping cover serving to provide a composite shipping package that includes a piston assembly for the well known standardized AB-type air brake system for which detailed service and maintenance instructions are prescribed under the authority of the AAR in connection with the procedures for reconditioning and testing brake cylinder pistons.

In accordance with the standardized maintenance procedures, it is required periodically to remove the air brake piston assemblies and replace them with new or reconditioned parts of the same type. Generally, all cleaning and conditioning of the removed piston assemblies is performed in a central service yard. After being removed from a railroad car, the piston assembly is shipped back to the service yard. After being removed from a railroad car, the piston assembly is shipped back to the service yard. After servicing, it is then shipped out to repair tracks for storage until it is needed again. During shipment and storage, the piston assemblies which are required to function precisely and which are required to be free of contaminants are exposed to rough handling, inclement weather and dust and dirt, all of which tends to degrade its internal mechanisms.

In the past, there has been no suitable container provided for protecting the piston assembly during shipment and storage. The fact is that the equipment is frequently protected only by a gunny sack or other fragile wrapping incapable of preventing mechanical damage or contamination. The result of this is that the essential purpose of the extensive and careful maintenance procedures is lost.

SUMMARY OF THE INVENTION

In accordance with the present invention, a dual purpose shipping cover for the air brake piston assembly is provided to facilitate shipping and storage of the piston assembly. The particular AB-type piston assembly includes a sleeve, a piston, a head having a stepped diameter free end profile and spring means biasing the piston and head apart.

The shipping cover of the invention cooperates with the conventional air brake cylinder for defining a shipping package or it serves in a matched pair to define a shipping package for the piston assembly.

The shipping cover comprises a body of stepped diameter having a main length portion to accept the piston, a reduced end portion to accept the free end of the head, the main length portion having an open end bordered by a circumambient marginal flange of a shape to engage the outboard mounting flange of the cylinder in confronting face-to-face relation, the main length portion of the cover having a depth corresponding to the depth of the cylinder.

To complete the shipping package, locking means are provided for securing the confronting flanges together. The locking means of the preferred embodiment comprises an open-loop locking ring generally U-shaped in transverse section to define an annular pocket opening inwardly of the ring for receiving the flanges edgewise. The ring has confronting opposite ends and releasable clamping means connecting these ends to hold the ring contracted upon the flanges for compressing the same together.

To facilitate sealing the shipping cover either against the cylinder flange or against the flange of a matching cover, the cover flanges have a marginal lip portion of the same thickness as the cylinder flange such that the total flange thickness presented to the locking ring is the same for both types of shipping containers.

Other features and advantages of the invention will be apparent from the following description and claims and are illustrated in the accompanying drawings which show structure embodying preferred features of the present invention and the principles thereof, and what is now considered to be the best mode in which to apply these principles.

BRIEF DESCRIPTION OF THE DRAWINGS

In the accompanying drawings forming a part of the specification, and in which like numerals are employed to designate like parts throughout the same.

DESCRIPTION OF PREFERRED EMBODIMENT

Figure 1:
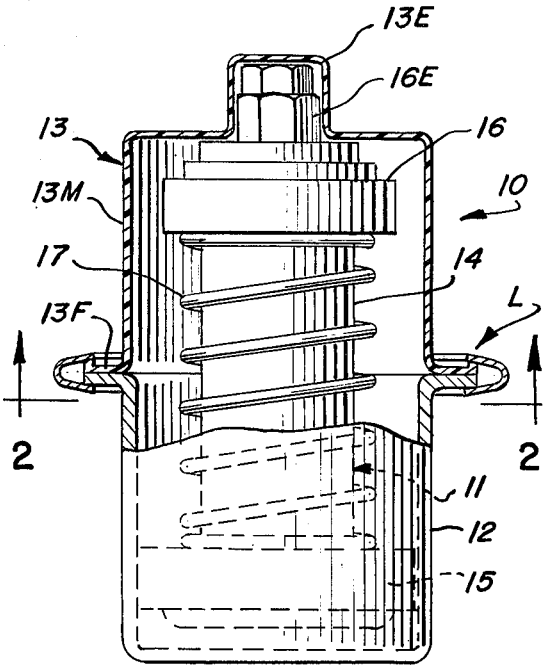
FIG. 1 is an elevational view of a shipping package that includes an AB-type railroad air brake piston assembly, a shipping cover engaging a conventional cylinder and a clamping ring.

Referring now to the drawings, as shown in FIG. 1 a shipping package designated generally at 10 includes the piston assembly 11 for an AB-type air brake system mounted in a conventional air brake cylinder 12 and covered by a shipping cover 13 that seats on the cylinder 12. A locking means L secures the cover 13 in sealed relation upon the cylinder 12.

The piston assembly is entirely conventional and includes a sleeve 14, a piston 15, a head 16 having a stepped diameter free end profile 16E, and spring means 17 biasing the piston 15 and the head 16 apart.

In accordance with the present invention, the shipping cover 13 comprises a body of stepped diameter having a main length portion 13M to receive the piston, a reduced end portion 13E to receive the free end of the head and a marginal outboard flange 13F bordering the open end of the main length portion to cooperate with the usual flange 12F on the cylinder.

Figure 2:
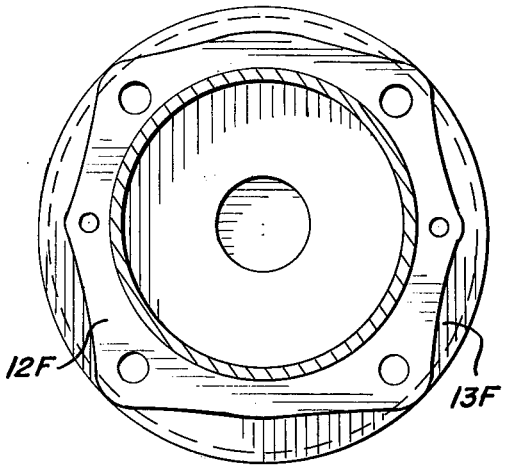
FIG. 2 is a plan view showing the flanges of the cylinder and the shipping cover in superimposed relation.

The cylinder flange 12F, as shown in plan outline in FIG. 2, has a cylindrical inner diameter equal to that of the shipping cover and has a generally rectangular outer periphery that has corner dimensions equal to the outer diameter of the shipping cover flange 13F.

Figure 4:
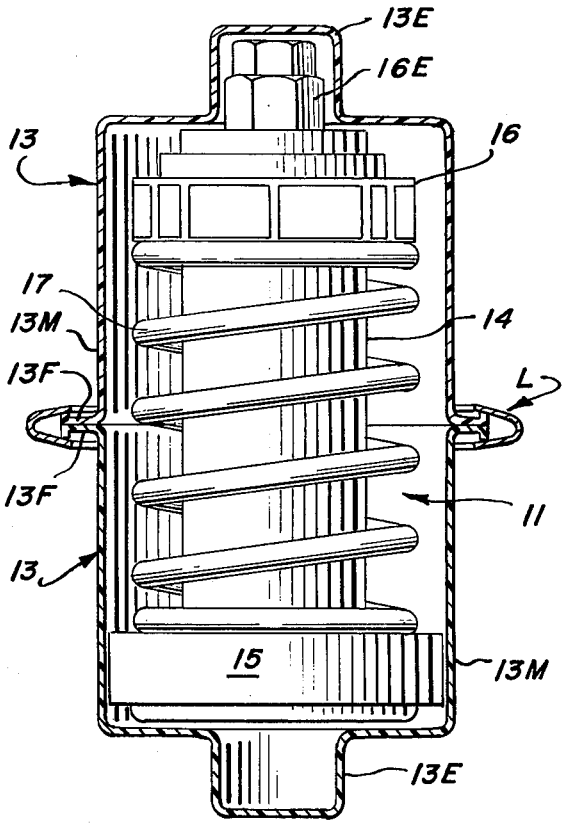
FIG. 4 is a view similar to FIG. 1 and showing a shipping package comprised of a pair of matched shipping covers enclosing an AB-type piston assembly and secured by a clamping ring.
Figure 5:
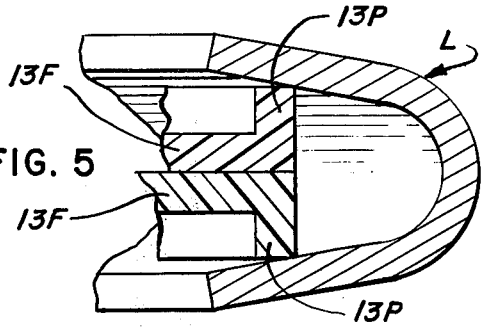
FIG. 5 is an enlarged section through the flange region of the shipping package of FIG. 4 and showing a clamping ring in contracted relationship upon the flanges of the shipping covers.

The shipping cover flange 13F has a marginal upstanding lip portion 13P to present a flange thickness substantially equal to that of the cylinder flange. It should also be noted that the main length portion of the cover has a depth corresponding to the depth of the cylinder. This depth dimension provides a snug relation at the intermediate region of the stepped diameter head 16, and it allows the covers to be used in matched pairs for providing a complete shipping package for the piston assembly 11 as shown in FIGS. 4 and 5. The dimensioning of the flanges 13F being matched to the thickness and to the outside dimensions of the cylinder flange allows the same locking means L to be used for both types of shipping package.

Figure 3:
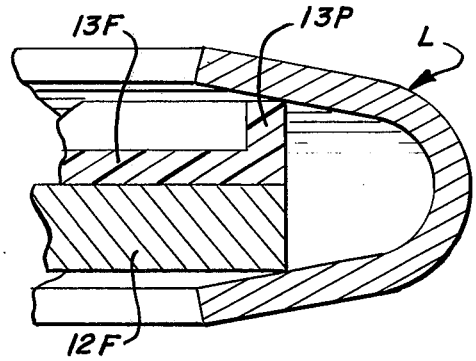
FIG. 3 is an enlarged section through the flange region of the shipping package of FIG. 1 and showing a clamping ring in contracted relationship upon the flanges of the cylinder and shipping cover.
Figure 6:
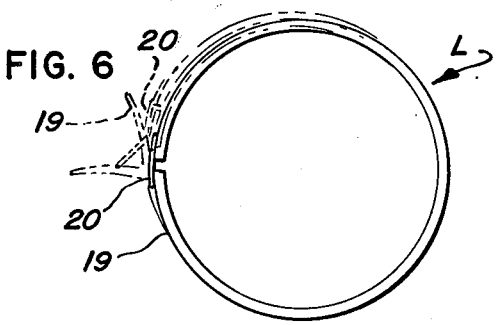
FIG. 6 is a perspective view of the clamping ring.

The locking means L comprises an open loop locking ring 18 which is shown to be generally U-shaped in transverse section (see FIGS. 3 and 5) to define an annular pocket 18P opening inwardly of the ring for receiving the flanges 12F, 13F edgewise therein. The ring 18 has confronting opposite ends interconnected by a toggle-type clamping mechanism that includes a lever 19 pivoted to one of the ring ends and a bail 20 pivoted to the other ring end and pivoted centrally to the lever. The lever 19 is shiftable between a fully open position through an intermediate position, as shown in dotted lines in FIG. 6, to a locking position as shown in full lines in FIG. 6.

In the locking position the lever 19 holds the ring 18 contracted upon the abutting flanges for compressing the flanges together.

The composite shipping package of FIG. 4 provides a particularly effective seal in that the locking ring exerts substantially uniform seal pressure throughout the full 360° periphery of the flanges 13F. It is preferred that where the piston assembly is removed, the locking ring 18 is actuated to its contracted position where is serves to hold the empty package components together, thus minimizing possible loss and also precluding mechanical damage to the seal face.

In the disclosed embodiment, the shipping drum 12 is formed of a high impact plastic material such as a rotor-molded, cross-linked polyethylene. This material provides light-weight easy formability, high impact, shock and compressive strength, and a degree of resiliency capable of cushioning the piston assembly 11 against shocks in the event of accidental dropping.

Drop tests of the shipping package show that the drum can withstand free falls of several feet without buckling while free falls of more than 20 feet are handled by limited temporary flexing or bowing followed by automatic restoration of the original shape.

It should be noted that some clearance exists between the piston assembly and the cover walls to allow the cover, in the event of accidental dropping, to flex or bow inwardly and develop effective cushioning without damage to the assembly.

The properties of cross-linked polyethylene at temperatures as low as −35°F are comparable to the properties of most substitutes at room temperature. Its properties are good up to 200°F.

Thus, while preferred constructional features of the invention are embodied in the structure illustrated herein, it is to be understood that changes and variations may be made by those skilled in the art without departing from the spirit and scope of the appended claims.

What is claimed is:

1. A composite shipping package comprising, in combination:

an AB type railroad air brake piston assembly, a dual purpose shipping cover engaging a container component to provide a container for said piston assembly, and locking means for maintaining said shipping package in assembled relationship;

said AB piston assembly including a sleeve, a piston, a head having a stepped diameter free end and spring means biasing said piston and said head apart; said container component comprising an air brake cylinder including a cylindrical main body having a circular open end bordered by an outboard mounting flange, said mounting flange having a generally rectangular profile; said shipping cover comprising a body of stepped diameter having a main length portion cooperating with and enclosing said piston and a reduced end portion cooperating with and enclosing the free end of said head, said main length portion of said cover and said container component having substantially the same depth, said main length portion of said cover also having an open end bordered by a marginal flange to engage said container component mounting flange in face-to-face confronting relation, said mounting flange and said shipping cover marginal flange having substantially the same thickness; and said locking means securing said marginal flange to said mounting flange to maintain the shipping package in assembled relationship.

2. A composite shipping package as defined in claim 1 wherein the locking means includes an open-loop locking ring generally U-shaped in transverse section to define an annular pocket, opening inwardly towards said flanges, to receive and contract said flanges together.

3. A composite shipping package as defined in claim 1, wherein said cover is formed from polyethylene having high impact, resilience and shape restoring characteristics.

* * * * *